US007913512B2

(12) United States Patent
Baudat et al.

(10) Patent No.: US 7,913,512 B2
(45) Date of Patent: Mar. 29, 2011

(54) AIR-HEATED HEAT EXCHANGER

(75) Inventors: Ned Phillip Baudat, New Braunfels, TX (US); Frank Patrick Ross, Houston, TX (US); Randy Michael Sharp, Houston, TX (US)

(73) Assignee: Wood Group Advanced Parts Manufacture, AG (CH)

( * ) Notice: Subject to any disclaimer, the term of this patent is extended or adjusted under 35 U.S.C. 154(b) by 244 days.

(21) Appl. No.: 11/405,854

(22) Filed: Apr. 18, 2006

(65) Prior Publication Data

US 2007/0240862 A1 Oct. 18, 2007

(51) Int. Cl.
*F25D 17/04* (2006.01)

(52) U.S. Cl. ..... 62/404; 62/506; 165/146; 165/150

(58) Field of Classification Search ..... 165/146, 165/150; 62/404, 506, 515
See application file for complete search history.

(56) References Cited

U.S. PATENT DOCUMENTS 3,385,073 A * 5/1968 Snelling ..... 62/52.1
4,381,592 A * 5/1983 Venables et al. ..... 29/890.048
4,693,307 A * 9/1987 Scarselletta ..... 165/152
4,901,607 A * 2/1990 Beugelsdyk et al. ..... 81/63.2
5,311,935 A * 5/1994 Yamamoto et al. ..... 165/152
5,472,047 A * 12/1995 Welkey ..... 165/172
5,848,638 A * 12/1998 Kim ..... 165/151
6,659,170 B1 * 12/2003 Kale ..... 165/122
6,662,858 B2 * 12/2003 Wang ..... 165/80.3
6,789,317 B1 * 9/2004 Sohal et al. ..... 29/890.046
6,928,833 B2 * 8/2005 Watanabe et al. ..... 62/515
2005/0257921 A1 * 11/2005 Hu ..... 165/140

* cited by examiner

*Primary Examiner* — Melvin Jones

(74) *Attorney, Agent, or Firm* — J. M. (Mark) Gilbreth; Mary A. Gilbreth; Gilbreth Roebuck, P.C.

(57) ABSTRACT

A heat exchanger comprises a first tube having a first fin of a first predetermined height extending outward therefrom. A second tube is vertically spaced above the first tube. The second tube has a second fin of a second predetermined height extending outward therefrom. A fan is positioned to force ambient air across the second tube and then across the first tube to heat a fluid flowing therethrough. A method of heating a fluid comprises sequentially flowing the fluid upward through a plurality of vertically spaced rows of substantially horizontal tubes, and forcing air downward over the plurality of tubes to heat the fluid.

21 Claims, 3 Drawing Sheets

AIR-HEATED HEAT EXCHANGER

REFERENCE TO RELATED APPLICATIONS

Not Applicable

STATEMENT REGARDING FEDERAL FUNDING

Not Applicable

BACKGROUND OF THE INVENTION

1. Field of the Invention

The present invention relates to heat transfer apparatus and methods. It further relates to apparatus and methods for the transfer of heat from one fluid to another fluid, and more particularly to an air-heated heat exchanger for heating low-temperature fluids.

2. Description of the Related Art

Heat exchanger apparatus are well known for transferring heat from one medium to another. Heat transfer is an engineering concern in a wide range of processes and systems and is utilized in many industries, such as, for example, the generation of energy, chemical production, refining of petroleum products, air conditioning, and automotive industry, to list but a few. Heat exchangers can be classified based on their design such as, for example, shell and tube designs, double pipe type shell and tube designs, plate and frame designs, plate-fin designs, bare tube designs, and finned-tube designs. The performance efficiency of the variety of heat exchangers varies considerably and is dependent upon a number of factors including the design of the heat exchanger, the amount and efficiency of the heat transfer surface area, the temperature at which the heat exchanger is operating, and the fluids involved in the heat transfer process.

One approach to increase a heat exchanger's overall heat transfer rate is to increase the heat transfer surface by attachment of radial or longitudinal fins to the external surface of a heat exchanger tube. The art is filled with patents directed to finned-tube heat exchangers, and methods of using and making such finned-tube heat exchangers.

U.S. Pat. No. 4,901,667, issued Feb. 20, 1990 to Demetri discloses a gas-to-liquid heat exchanger formed by winding circular finned tubing into a helical coil having bare tubing wrapped around the coil such that it nests between adjacent turns of the finned tubing. Fittings at the inlets and outlets of both coils distribute the liquid stream so that a portion flows through each coil. The fan tube coil acts as a cooled baffle which directs the hot gas stream flowing over the finned tubes so that it contacts a greater portion of the finned tube external surface area at high velocity and increases the heat transfer effectiveness.

U.S. Pat. No. 5,472,047, issued Dec. 5, 1995 to Welkey discloses a heat exchanger tube bundle design for a shell and tube exchanger that eliminates the need for tube supports or baffles within a heat exchanger tube bundle. The Welkey tube bundle configuration uses a combination of bare tubes and longitudinally finned tubes positioned such that the longitudinal fins act as spacing and supporting means within the tube bundle. The longitudinal fins provide spacing and support substantially along the entire length of the tubes within the bundle and thereby eliminate the need for internal spacing or supporting means.

U.S. Pat. No. 5,848,638, issued Dec. 15, 1998 to Kim discloses a finned tube heat exchanger described therein as having a simple structure and increased heat exchanging performance. The heat exchanger has a plurality of fin plates spaced at regular intervals and arranged in parallel with one another, and a plurality of heat exchanger tubes extending through the fin plates and including a refrigerant fluid therein. Each of the fin plates has a plurality of strips projected from the surface thereof, and the strips include first to fifth rows of strips arranged between openings, which are disposed adjacent to one another, in a parallel relationship. The first row of strips is located near a leading edge of the fin plates and formed of two louverlike strips in a form of a trapezoid having a long side located on the upper stream of the air flow. Each of the second to fourth rows of strips is formed of one bridgelike strip in a form of a rectangle. The fifth row of strips is formed of two louverlike strips in a form of a trapezoid having a short side located on the upper stream of the air flow U.S. Pat. No. 6,659,170, issued Dec. 9, 2003 to Kale discloses a finned-coil heat exchanger having a housing with spaced walls defining an internal chamber with air flowing from an upstream end to a downstream end, spaced transfer tubes with heat conducting media flowing therein from the downstream chamber end to the upstream chamber end, a series of spaced fins in contact with the tubes to transfer heat to flowing air, and a fan unit to move air through the exchanger. An air inlet is defined at the upstream end of the housing or in the lower end of one of the walls so that air can enter the internal chamber. The tubes each extend tortuously back and forth on a plane parallel to the direction of air flow so that there is a counterflow effect across the various segments of each tube. The tubes have at least six segments extending transversely across air flow with the tubes and fins being sized and spaced to provide for better air flow through the heat exchanger housing.

U.S. Pat. No. 6,662,858, issued Dec. 16, 2003 to Wang discloses a counter flow heat exchanger with integrated fins and tubes comprising metal plates overlapping with each other. Each of the metal plates has multiple elongated ridges spacing apart from each other. Adjacent metal plates oppositely overlap with each other such that the ridges in pairs form horizontal tubes and multiple connecting tubes on the plates form vertical tubes. Fluid inside the heat exchanger flows counter to external air allowing heat exchange to be reached effectively.

U.S. Pat. No. 6,789,317, issued Sep. 14, 2004 to Sohal et al., discloses a system for and method of manufacturing a finned tube for a heat exchanger. A continuous fin strip is provided with at least one pair of vortex generators. A tube is rotated and linearly displaced while the continuous fin strip with vortex generators is spirally wrapped around the tube.

U.S. Pat. No. 6,928,833, issued Aug. 16, 2005 to Watanabe et al., discloses a heat exchanger finned tube for use in fabricating a heat exchanger useful as the evaporator for refrigerators or the like wherein a hydrocarbon refrigerant is used. Two tube insertion holes spaced apart from each other are formed in each of plate fins and two straight tube portions of a hairpin tube are inserted through the respective holes of each plate fin to arrange the plate fins in parallel into a plurality of fin groups spaced apart on the straight tube portions longitudinally thereof. The hairpin tube is enlarged with use of a fluid to fixedly fit the plate fins of each tin group around an enlarged tube portion of the hairpin tube and provide a finless part between each pair of adjacent fin groups on each of the straight tube portions. The heat exchanger fabricated using the finned tube exhibits the desired refrigeration performance with the leakage of refrigerant diminished.

SUMMARY OF THE INVENTION

In one aspect of the present invention, a heat exchanger comprises a first tube having a first fin of a height, $h_1$, extending outward therefrom. A second tube is spaced adjacent the first tube. The second tube has a second fin of a height, $h_2$, extending outward therefrom, wherein $h_2$ is different from $h_1$. A fan is positioned to force a gas across the first tube and the second tube.

In another aspect, a heat exchanger comprises a substantially horizontal first tube having a first fin of a first predetermined height extending outward therefrom. A substantially horizontal second tube is vertically spaced adjacent the first tube, the second tube has a second fin of a second predetermined height extending outward therefrom. A fan is positioned to force ambient air downward across the second tube and the first tube. A fluid flows through the first tube and then through the second tube.

In even another aspect, a method of heating a fluid comprises flowing the fluid upward through a plurality of vertically spaced rows of tube, and forcing air over the plurality of tubes to heat the fluid.

BRIEF DESCRIPTION OF THE FIGURES

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention, wherein.

DETAILED DESCRIPTION OF THE INVENTION

Figure 1:
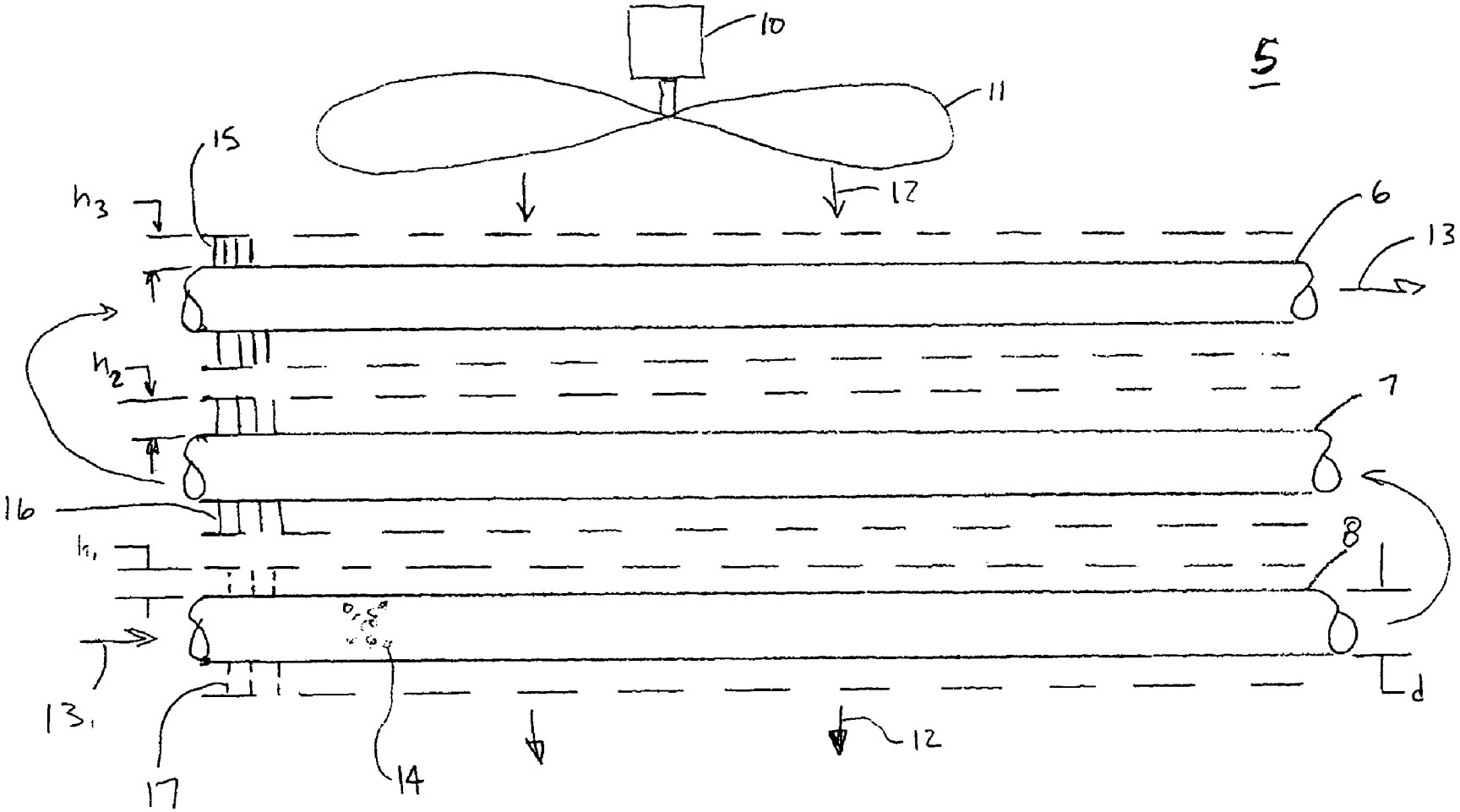
FIG. 1 is a sketch of one embodiment of a tube arrangement for an air-heated exchanger according to the present invention.

FIG. 1 illustrates one embodiment of the present invention, wherein air-heated heat exchanger 5 comprises tubes 6, 7, 8 arranged horizontally such that tube 6 is vertically spaced adjacent tube 7. Likewise, tube 7 is vertically space adjacent tube 8. Fluid 13 flows through the tubes from lower tube 8 sequentially through tube 7 and tube 6. Each of the tubes 6, 7, and 8 may have fins 15, 16, and 17 attached respectively thereto. Fins 15, 16, and 17 have height $h_3$, $h_2$, and $h_1$, respectively. Ambient air 12 is forced to flow downward across the tubes in essentially a counter flow exchanger arrangement by fan 11 driven by electric motor 10. While shown as a single fan, multiple fans may be used. Alternatively, any combination of fans and blowers of types known in the art may be used to force air across tubes 8, 7, and 6.

Fins 15, 16, and 17 may be of any type known in the art, such as, for example, spiral fins, and L-shaped fins. The fins act to increase the effective heat transfer surface area of each tube. The tubes and fins of the present invention may be constructed from any suitable material known in the art including steel, copper, aluminum, and alloys. The surface of the fins may be plain or they may be perforated, serrated, or comprise ripples, wrinkles, or bumps. These features improve the heat transfer from the surface of the fin to the air by increasing the fin surface area, increasing turbulence and reducing air bypass.

Figure 2:
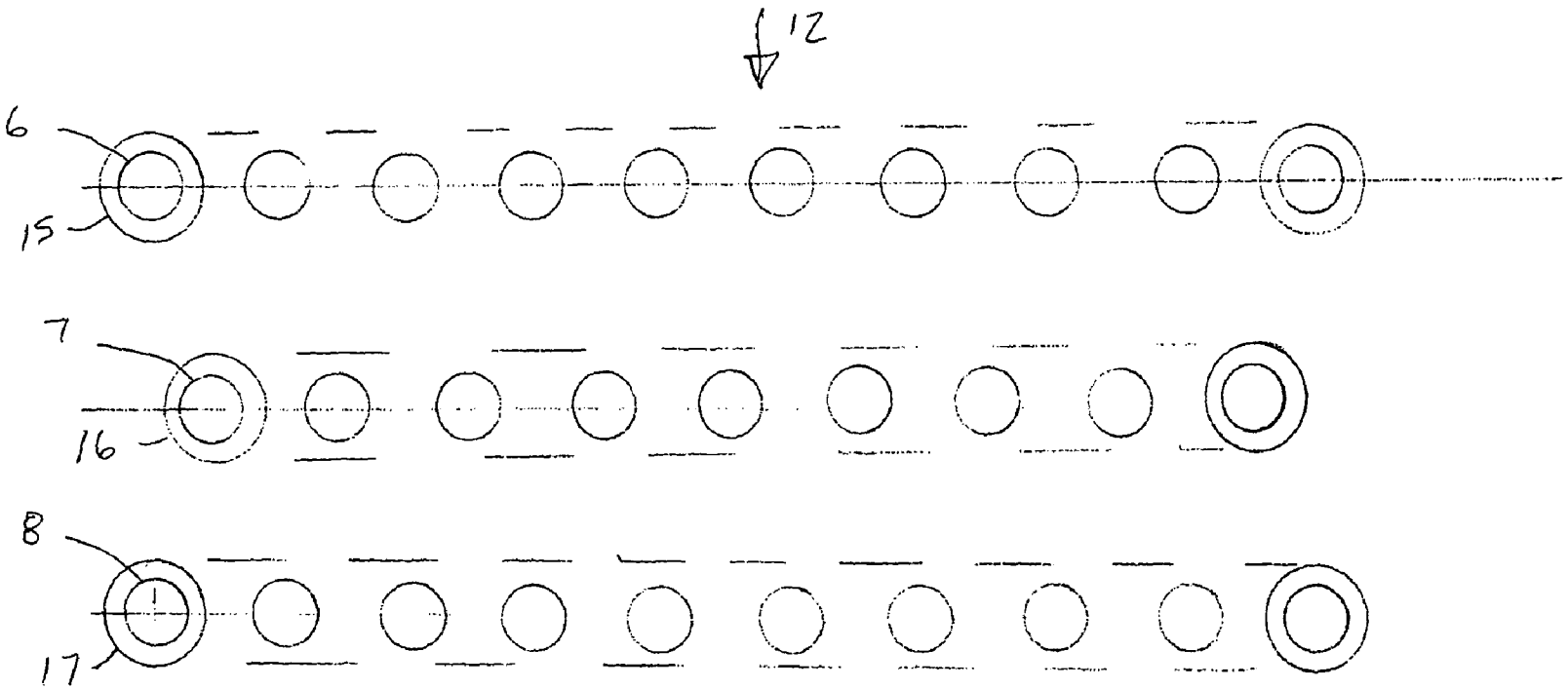
FIG. 2 is a sketch of a staggered tube arrangement.

In operation, each of tubes 6, 7, and 8 represents a row of tubes, as shown in an end view in FIG. 2. FIG. 2 depicts a staggered arrangement of tubes. By arranging tubes in a staggered, also called triangular, pattern, with transversely oriented rows of tubes staggered, the tubes can be closer together while still maintaining a sufficient open area percentage for airflow through the exchanger. For example, in a typical equilateral spacing of 2.5 inches (63.5 mm) between tubes having 1 inch (25.4 mm) diameter, the open area at any row of the coil (1 row % open) is about 60%. Also, the air passing through the coil is forced to go over and around each succeeding row of tubes. When a second staggered row is considered in the open area calculation, then the projected open area (2 row % open) nominally becomes about 20%. The triangular pattern significantly reduces bypass air without causing high pressure drops, and although tubes are partially "shadowed", the increased air turbulence provides better air flow to the "shadowed" spots.

Alternatively, the tubes can be arranged in straight rows (not shown) and columns. Some advantages are obtained from the relative simplicity of such an arrangement. However, such an arrangement allows for a relatively high amount of bypass air. Another problem arises in that, except for the air side tube, each tube in a column is directly in the "shadow" of another tube, and does not receive an adequate flow of air. As a result, the most important portions of the fins, which are closest to the tubes, are in the "shadows" and do not receive adequate air flow, either.

Fin density is determined on an application dependent basis using techniques known in the art. Fin density may range from 4 fins/inch to 20 fins/inch. More commonly, the fin density is about 8-10 fins/inch. Fin height ranges from 0 to about ⅝ inch. Tube diameters range form ½-4 inches. Tube spacing ranges from about 1¾-4 inches for 1 inch diameter tubes, with 1¾-2¾ inches being more common, and from about 2¼-5 inches for 1.5 inch diameter tubes, with 2¼-3¼ inches being more common. Tubes may be in the range of 5 to 60 feet in length. For long sections, multiple fans may be used, as described previously.

In one embodiment fluid 13 is a low-temperature secondary fluid having an operating temperature in the range of about −15° F. to about 30° F. As used herein, a secondary fluid is a fluid used in a closed-loop circulation system to act as an intermediate medium to transfer heat from the ambient air 12 to a third fluid (not shown), for example a liquefied natural gas (LNG), that is being heated and/or vaporized. An example of such a system is described in U.S. Published Application 2005/0274126 A1 published on Dec. 15, 2005, which is assigned to the assignee of the present application, and which is incorporated herein, by reference. Secondary fluids for use as fluid 13 include, but are not limited to: (i) aqueous potassium formate solution, (ii) propane, (iii) refrigerant R22, (iv) ammonia; and (v) glycol/water solution. Alternatively, fluid 13 may be a primary fluid, such as, a cryogenic fluid, for example, LNG, that is heated and/or vaporized as it flows through tubes 6, 7, and 8.

Ambient air 12, see FIG. 1, is forced to flow downward across the tubes in essentially a counter flow exchanger arrangement by fan 11 driven by electric motor 10. As one skilled in the art will appreciate, the temperature of air 12 will decrease as it passes downward through exchanger 5, while the temperature of fluid 13 will increase as it moves upward through exchanger 5. In one embodiment, lower tube 8 is a bare tube without extending fins. The rate of flow of air 12 through exchanger 5 is selected to allow condensed liquid 14 from air 12 to condense on the outside of tube 8. The condensed liquid 14 provides enhanced heat transfer from fluid 13, inside tube 8, to air 12. The relatively high latent heat of condensation of water in the condensed liquid 14 from air 12 is a substantially greater source of energy to heat fluid 13 than would be straight convective heating. The selection of air flow based on the flow of coolant and the ambient temperature and humidity of the air to maintain a condensing liquid on lower tube 8 is within capability of those skilled in the art. The selection of the tube material and fin height for each row in view of the ambient conditions provides a controlled condensation that allows operation of the exchanger without a significant frost buildup and therefore substantially eliminates the need for defrosting of the exchanger tubes.

Figure 3:
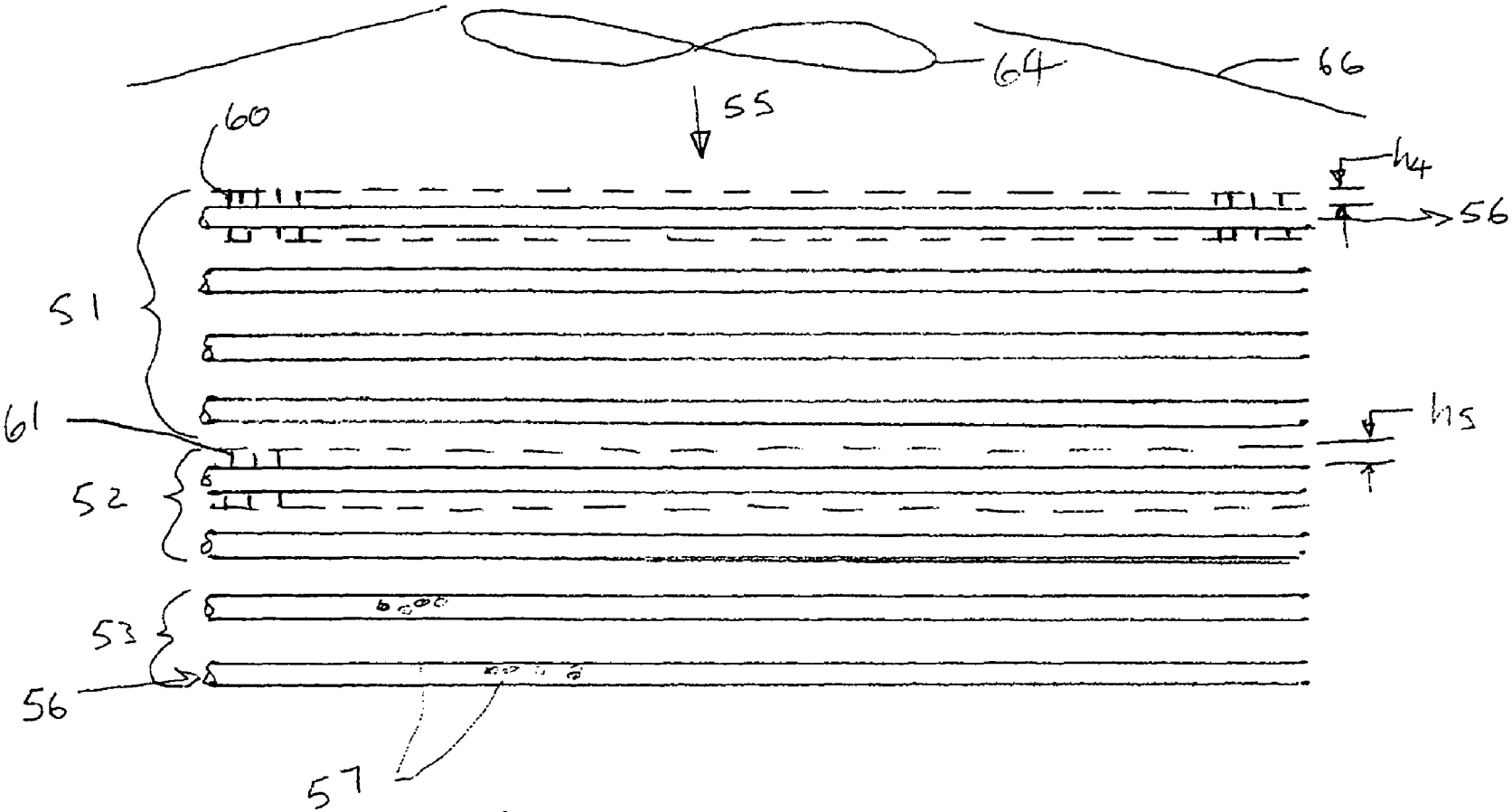
FIG. 3 is a sketch of a tube arrangement having eight rows of tubes.

Fin heights $h_3$, $h_2$, and $h_1$ are each selected to obtain a temperature profile through the exchanger to enhance the condensation of condensed liquid 14 on lower tube 8. While described above with respect to three rows of tubes, one skilled in the art will appreciate that any suitable numbers of rows of exchanger tubes may be stacked. For example, FIG. 3 shows an exchanger tube arrangement having eight rows of tubes arranged with several different fin heights. Four tubes 51 have fin 60 with height $h_4$. Two tubes 52 have fin 61 with height $h_5$, while the remaining two tubes 63 are bare tubes with no fins having condensed liquid 57 condensing thereon. Ambient air flow 55 is forced downward across the tubes by fan 64 while a fluid 56 travels upward sequentially through each successive tube. Shroud 66 may surround fan 64 to enhance air flow over the tubes. Such an exchanger tube arrangement may be used with either a secondary fluid loop or a primary fluid loop, as described above.

While described herein as a substantially horizontal assembly, it is contemplated that the present invention covers applications where the tubes are inclined from the horizontal up to about 70°.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

What is claimed is:

1. A heat exchanger comprising: a first tube having a first fin of a height, $h_1$, extending outward therefrom; a second tube spaced adjacent the first tube, the second tube having a second fin of a height, $h_2$, extending outward therefrom, wherein $h_2$ is different from $h_1$; and a fan positioned to force a gas to flow in a path sequentially past the first fin of height $h_1$ and then the second fin of height $h_2$.

2. The heat exchanger of claim 1, further comprising a fluid flowing sequentially through the first tube and the second tube.

3. The heat exchanger of claim 1, wherein $h_1$ is less than $h_2$.

4. The heat exchanger of claim 1, further comprising a third tube spaced adjacent the second tube, the third tube having a third fin of a height, $h_3$, extending outward therefrom; wherein the fan is positioned to force a gas sequentially across the first tube, the second tube and the third tube.

5. The heat exchanger of claim 3, wherein $h_2$ is less than $h_3$.

6. The heat exchanger of claim 1, wherein $h_1$ is substantially zero making the first tube a bare tube.

7. The heat exchanger of claim 6, wherein the first tube comprises an outer surface, the heat exchanger further comprising a condensed fluid layer on the outer surface of the first tube to enhance thermal transfer.

8. The heat exchanger of claim 1 comprising a plurality of first fins spaced apart along the first tube.

9. The heat exchanger of claim 1 comprising a plurality of second fins spaced apart along the second tube.

10. The heat exchanger of claim 3 comprising a plurality of third fins spaced apart along the third tube.

11. The heat exchanger of claim 1, wherein the first tube comprises a plurality of vertically spaced horizontal rows of first tubes.

12. The heat exchanger of claim 1, wherein the second tube comprises a plurality of vertically spaced horizontal rows of second tubes.

13. The heat exchanger of claim 3, wherein the third tube comprises a plurality of vertically spaced horizontal rows of third tubes.

14. The heat exchanger of claim 2, wherein the fluid is chosen from the group consisting of: (i) an aqueous potassium formate solution, (ii) propane, (iii) refrigerant R-22, (iv) ammonia, and (v) a glycol/water solution.

15. The heat exchanger of claim 2, wherein the fluid is a cryogenic fluid.

16. The heat exchanger of claim 1 wherein the first tube and the second tube are substantially horizontal tubes.

17. The heat exchanger of claim 1, wherein the first tube and the second tube are inclined from horizontal.

18. The heat exchanger of claim 1, wherein the gas comprises ambient air.

19. A heat exchanger comprising: a substantially horizontal first tube having a first fin of a first predetermined height extending outward therefrom; a substantially horizontal second tube vertically spaced adjacent the first tube, the second tube having a second fin of a second predetermined height different than the first predetermined height extending outward therefrom; and a fan positioned to force ambient air downward in a sequential path across the second fin and then the first fin.

20. A method of heating a fluid comprising: flowing the fluid through a first tube and an adjacent second tube; and forcing air in a sequential path over a first fin of a height $h_1$ extending outwardly from the first tube and then over a second fin of a height, $h_2$ different than $h_1$ extending outwardly from the second tube to heat the fluid.

21. The method of claim 20, further comprising forcing air flow to allow condensed liquid to form on at least one tube.

* * * * *